US006418982B1

(12) United States Patent
Zhang et al.

(10) Patent No.: US 6,418,982 B1
(45) Date of Patent: Jul. 16, 2002

(54) PROCESS OF BULK FILLING

(75) Inventors: Jack Y. Zhang; Mary Ziping Luo; Frank Z Xia, all of South El Monte, CA (US)

(73) Assignee: Amphastar Pharmaceuticals Inc., Rancho Cucamonga, CA (US)

( * ) Notice: Subject to any disclaimer, the term of this patent is extended or adjusted under 35 U.S.C. 154(b) by 0 days.

(21) Appl. No.: 09/718,111

(22) Filed: Nov. 21, 2000

(51) Int. Cl.[7] ..... B65B 1/04

(52) U.S. Cl. ..... 141/4; 141/65; 141/37; 141/2; 141/18; 141/234

(58) Field of Search ..... 141/2, 4, 7, 65, 141/66, 37, 18, 234, 237, 85–87, 89, 91

(56) References Cited

U.S. PATENT DOCUMENTS 1,922,458 A * 8/1933 Schaeffer
3,282,306 A * 11/1966 Greenhut
4,061,163 A * 12/1977 Decker et al.
4,713,925 A * 12/1987 Kafkis

* cited by examiner

*Primary Examiner*—Steven O. Douglas
(74) *Attorney, Agent, or Firm*—Albert O. Cota

(57) ABSTRACT

A process of bulk filling containers which includes the steps of arranging a number of containers upside down in a tray (24) that has a raised peripheral lip (26). This tray full of containers is then placed in a vacuum chamber (28) which is then evacuated to a predetermined level below atmospheric pressure. Liquid (36) is then introduced into the tray through a reservoir (38) and conduit (40) which penetrates the wall of the vacuum chamber and the vacuum within the chamber is gradually released at a rate that draws the liquid into the containers. At this point in the process unwanted liquid is rinsed away and the tray is removed from the chamber and turned right side up. The final step is to seal the top of the containers with an appropriate cap, barrier, tip or connection. A second embodiment adds a step to the process by positioning the containers upside down in a rack (74) and positioning the rack directly above the tray containing the liquid. The rack is then lowered until the container necks are immersed in the liquid. The level of liquid is maintained as above and the balance of the process is conducted the same as the preferred embodiment.

10 Claims, 6 Drawing Sheets

PROCESS OF BULK FILLING

TECHNICAL FIELD

The invention pertains to bulk filling containers in general and more specifically, to a process for simultaneously drawing a liquid into a plurality of containers by surrounding the containers in a vacuum and introducing the liquid into a tray then reducing the vacuum or adding slowly pressure to allow the liquid to be drawn into the container.

BACKGROUND ART

Previously, many methods have been used to provide an effective means of filling containers with a liquid. In volume production it is common to utilize conveyers, where one or more tubes or hollow needles connected to a liquid-filled reservoir insert the liquid under pressure into the containers. The appropriate volume of liquid is usually controlled with valves or positive displacement pumps that modulate in sequence with the conveyer to insert just the correct amount at the proper time. While this process is effective, the speed is normally limited to some 100 to 1,000 units per minute.

A search of the prior art did not disclose any patents that possess the novelty of the instant invention, however the following U.S. patents are considered related:

| U.S. Pat. No. | Inventor | Issue Date |
|---|---|---|
| 6,089,676 | Poynter et al. | Aug. 8, 2000 |
| 4,114,659 | Goldberg et al. | Sep. 19, 1978 |

Poynter, et al. in U.S. Pat. No. 6,089,676 teaches a process and apparatus for providing an air shower to a critical fill zone of a liquid filling operation for preventing entry of particulate, non-viable and viable particulate, into the critical filling zone by providing opposed flows of pressurized air in laminar flows.

U.S. Pat. No. 4,114,659 issued to Goldberg, et al. is for a pipette filling and liquid dispensing device that is attached to a pipette by a flexible conduit. A resilient, compressible bulb is connected to the conduit, in which a closable opening is provided. By means of the opening, an alternate connection may be established between the interior of the conduit and the opening by uncovering the opening. A valve unit is inserted into the conduit, and as it is releasably connected with the conduit, it is also easily removed.

DISCLOSURE OF THE INVENTION

In the past, when large quantities of items were to be bottled or filled into smaller containers, some type of automation was required which was expensive to procure and in most cases was dedicated to a single product line. This approach was reasonable and well-accepted in the art, however, there are some drawbacks when it comes to smaller containers, particularly if the neck is under 0.50 inches (1.27 cm) in diameter. There is a time consideration for filling these containers, as a normal nozzle or hollow needle is limited in its diameter, as it can be no larger than the opening itself. In small opening containers the problem is amplified, particularly if the liquid to be filled is viscous. While most aqueous solutions, such as solvents are easily filled, emulsions, creams, ointments, lotion, paste, jelly and syrup create troublesome problems relative to the pressures required to inject the liquid through the nozzles and also the obvious expended time factors. Therefore the primary object of the invention is to circumvent the use of nozzles or small orifices and to utilize a pressure difference to draw the liquid into the container. This approach is convenient and has many advantages for the smaller containers, as a large number of containers may be processed at the same time, limited only by the size of a vacuum chamber and the capacity of the vacuum pump.

An important object of the invention is that the equipment may be used for a wide variety of liquids and configurations of containers, as the containers only need to be placed in a tray upside down, thereby making the size and shape of both the containers and tray of little importance.

Another object of the invention is that the liquid may be inserted into a diversity of containers, such as glass bottles, glass vials, glass tubes, plastic bottles, plastic vials, aluminum, or other metal tubes, plastic tubes, pipettes etc. and even semi-rigid plastic bags.

Still another object of the invention is that the containers may be nested together in close proximity, thus permitting a large number of containers to be processed in a minimum of space. The handling is also simple, as filled containers may be removed by hand or machines and manually or mechanically turned to attach a lid or applicator to the top or an entire rack or tray may be turned over, thus exposing the tops ready for attachment of a lid or an applicator.

Yet another object of the invention is that the head space or amount of air between the liquid and the lid may be easily calculated and the negative pressure level of the vacuum chamber predetermined, which permits complete control of the level of all of the containers simultaneously.

Another object of the invention is that the filled volume can be precisely controlled in microliters.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 2:
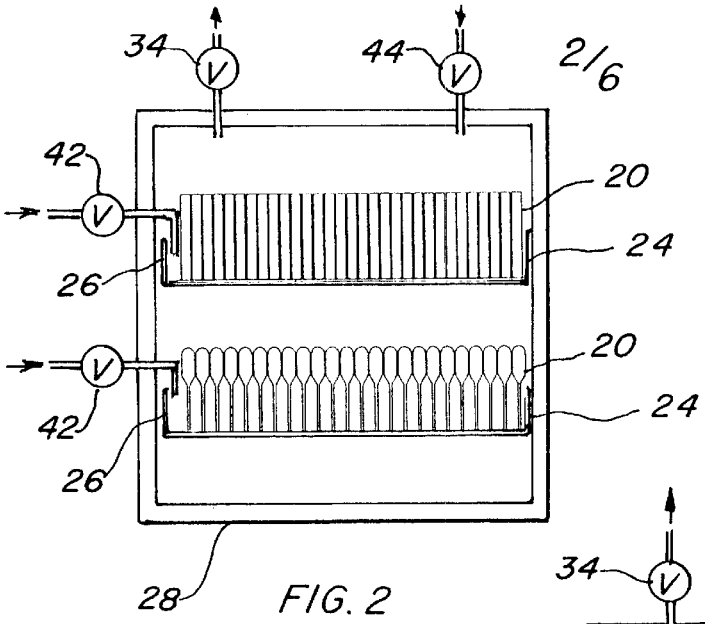
FIG. 2 is a schematic of the process with the containers placed upside down in the tray and the tray positioned within the vacuum chamber.
Figure 3:
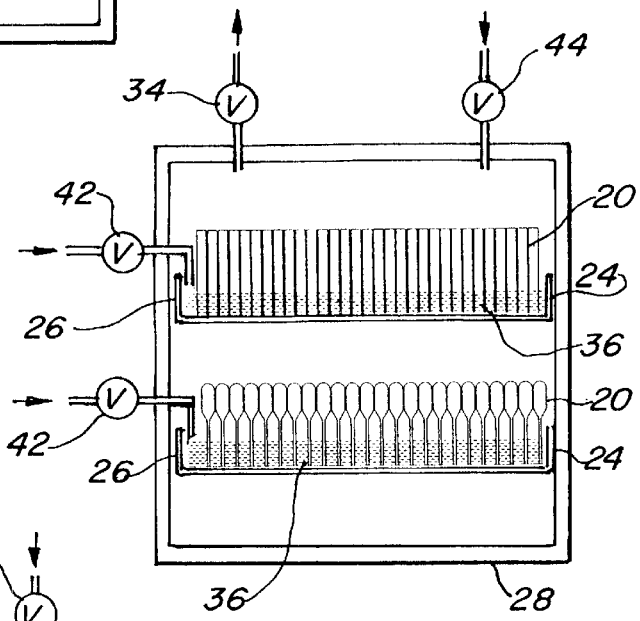
FIG. 3 is a schematic of the process with the containers placed upside down in the tray, the tray positioned within the evacuated chamber and the liquid introduced into the tray .
Figure 4:
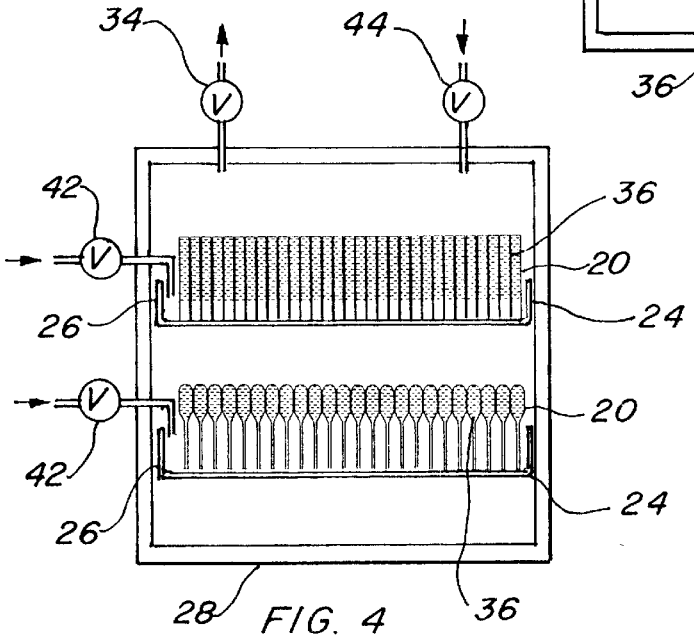
FIG. 4 is a schematic of the process with the containers placed upside down in the tray, the tray positioned within the evacuated chamber and the liquid introduced into the tray with the negative pressure reduced which allows the liquid to be drawn into the containers.

The best mode for carrying out the invention is presented in terms of a preferred and a second embodiment. Both embodiments are basically alike except the second embodiment positions the containers in a rack and lowers the rack into a tray. The balance of the invention is the same in components and function. The preferred embodiment is shown in FIGS. 1 through 9, which is comprised of a process for bulk filling liquid containers. The process comprises the steps of arranging a plurality of containers 20 that have a single opening 22 in their top, upside down in a raised peripheral lip tray 24, as shown in FIGS. 2 through 4. In the first step the containers 20 are stacked side by side in almost any array, however, for the most efficient use of the invention the containers 20 are tightly arranged such that they are contiguous with each other, thereby requiring no further need for a simple support within the tray 24. The tray 24 may be made of any material such as thermoplastic, or metal, as long as it has a peripheral lip 26 of a height to hold sufficient liquid and it is sealed to be watertight or solvent tight.

Figure 1:
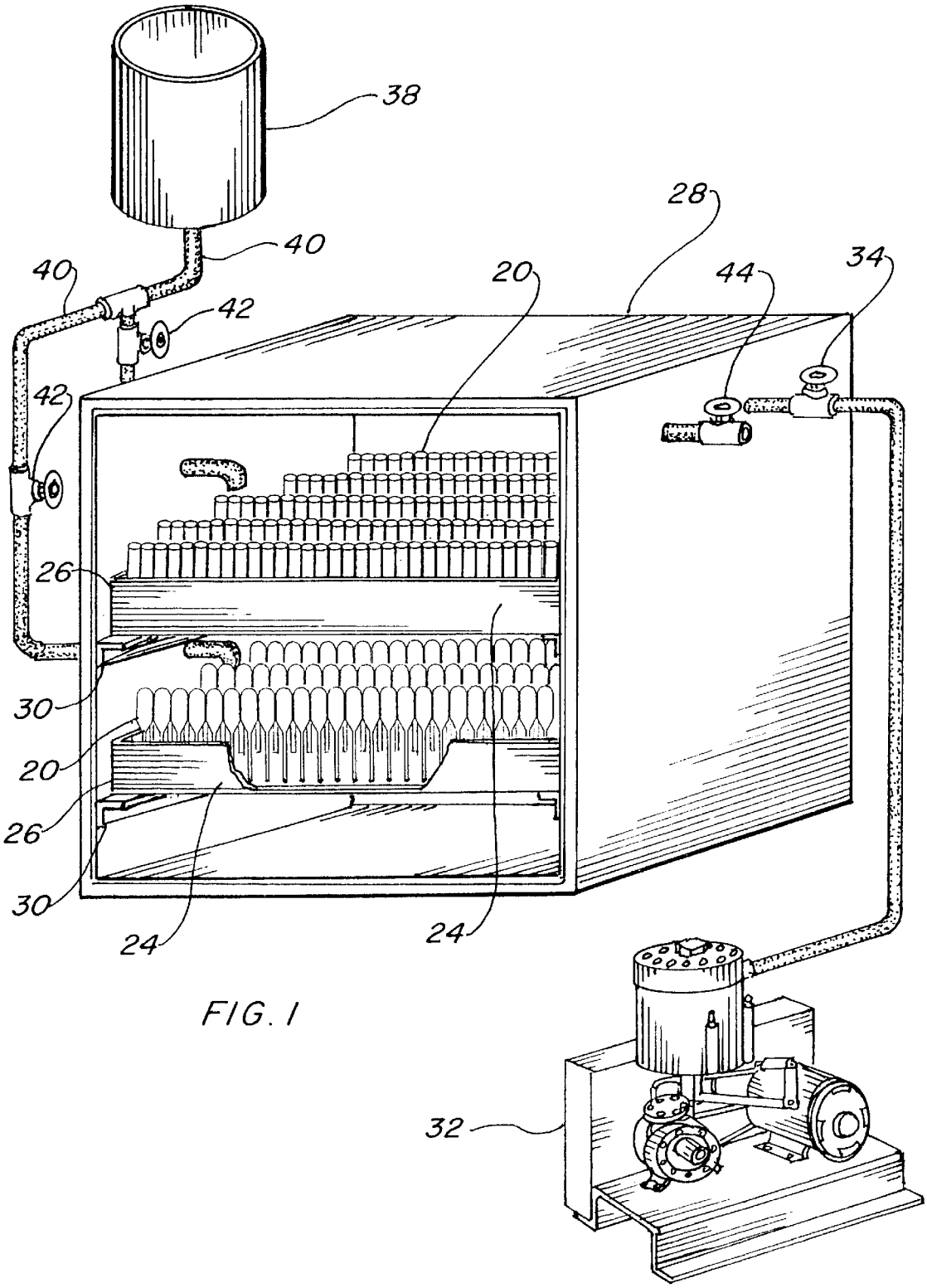
FIG. 1 is a partial isometric view of the preferred process at the point in the process when the trays have just been placed in the chamber prior to evacuation. The door of the vacuum chamber has been removed for clarity.
Figure 7:
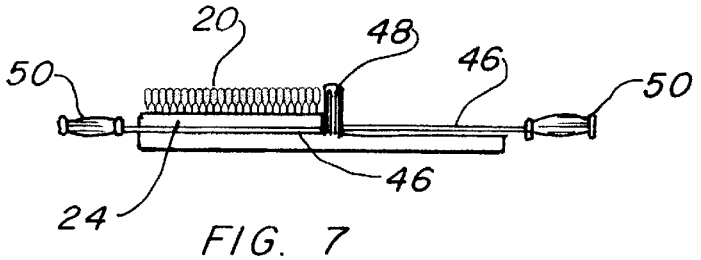
FIG. 7 is a diagram of the tray after being removed from the vacuum chamber with the containers still upside down.

The next step is positioning the tray 24, wherein the upside down containers have been placed, in a vacuum chamber 28, as illustrated in FIG. 1. The vacuum chamber 28 may be any type or configuration, is well known in the art and is readily available. It preferably that the chamber is equipped with shelves or guide rails 30, as illustrated in FIG. 7, to receive the trays 24, or an operator may simply place one or more trays 24 on top of each other to permit multiple filling of the containers 20.

Figure 5:
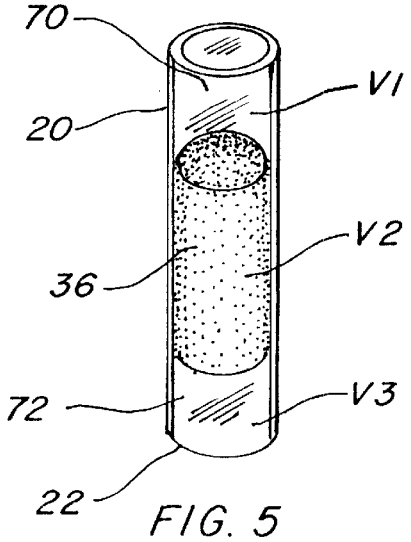
FIG. 5 is a schematic diagram of a straight walled container having a head space designated as V1 and a foot space designated as V3.
Figure 6:
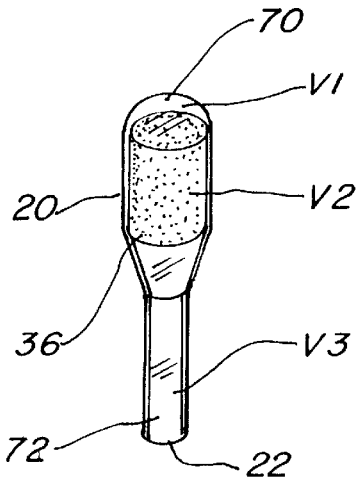
FIG. 6 is a schematic diagram of a container having a bulb section with a head space designated as V1 and a foot space designed as V3.
Figure 10:
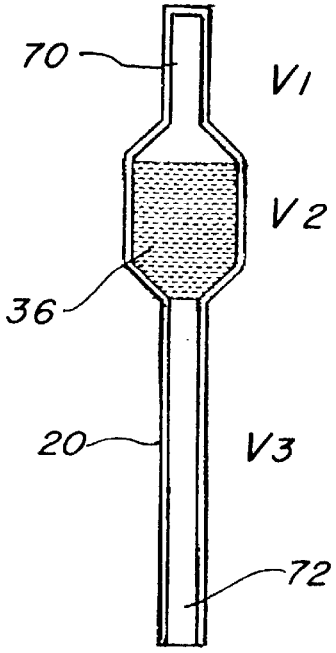
FIG. 10 is a representation diagram of a filled container in the form of a pipette with the volume of the pipette interior designated V1, V2 and V3 to correspond with the head space and foot space formula.

The vacuum chamber 28 is then evacuated with a vacuum pump 32 to a predetermined level below atmospheric pressure; the vacuum valve 34 that is attached to a line from the pump is then shut off. The pump may be one of a myriad of styles, such as a piston pump, a liquid ring pump, a rotary vane pump in both a single stage and a two stage type, a diaphragm pump or a host of others. The limiting factor in the selection of a pump is the amount of vacuum that is pulled, such as coarse, fine or high vacuum which may reach beyond 29.919 inches of mercury. Negative pressure is determined by the amount of head space desired within the container. The head space is defined as a void above the product within the container, thus permitting expansion and contraction of the liquid due to various prevailing atmospheric temperatures and pressure differentials. FIG. 5 and 10 illustrate the head space as $V_1$ with the volume of liquid in the container designated $V_2$ and the foot space $V_3$. FIG. 5 is a partial isometric view of a cylindrical container while FIG. 10 is a cross section of a pipette. The preferred vacuum negative pressure is selected as being only sufficient enough to leave the desired head space within the filled container. It has been found that a convenient method of calculating the appropriate negative pressure for head space control in a given application is by applying the following formula:

$$P_1 = \frac{V_1}{V_1 + V_2 + V_3} \times Po$$

Where:

$P_1$=absolute pressure in chamber $P_O$=environmental pressure $V_1$=volume of head space in container $V_2$=volume of product in container $V_3$=volume of container neck In order to calculate the amount of liquid that is required, the formula is: $V_2$×n+allowance, where n equals the number of containers in the tray. It should also be noted that the time to fill the containers is dependent upon the viscosity of the liquid product.

The next step in the process is to introduce the liquid 36 into the tray 24. This step is accomplished by utilizing a reservoir 38 with one or more liquid conduits 40 in the form of a pipe or tube that penetrates the side wall of the chamber 28. The formed is in such a manner as to be angled downward in alignment totally inside the lip 26 of the tray 24, as illustrated in FIGS. 1–4. A shut off valve 42 is positioned within each conduit 40 between the reservoir 38 and the outer surface of the chamber 28 to permit the proper amount of liquid to be introduced into the tray. The amount of liquid required to fill the containers 20 may be controlled by pre-measuring the volume or weight prior to introduction into the reservoir 38. Sight glasses, level gauges or flow meters may also be used for this volume control.

The next step is to release the vacuum within the chamber 28 gradually, at a rate that draws the liquid product 36 into the containers. This step is controlled by the use of a manual or automatic throttling valve 44 that introduces ambient air into the interior of the chamber 28. The rate is established by experimentation and experience, or a predetermined setting on the valve may be instituted based on the time element and the viscosity of the liquid.

The predetermined setting for terminated is established for the pressure level $P_2$ may be expressed by the following formula:

$$P_2 = \frac{V_1 Po}{V_1 + V_3} + Pr$$

Where:

$P_2$=absolute pressure in chamber $P_O$=environmental pressure $P_r$=pressure loss due to filling resistance in ml/sec $V_1$=volume of head space in container $V_2$=volume of product in container $V_3$=volume of container neck It should be noted that Pr is the pressure loss due to filling resistance which depends on the filling speed (ml/sec), the liquid viscosity, also the length and radius of the neck of the container, as designated $V_3$ in FIGS. 5 and 10.

When the chamber's interior pressure has reached and is stabilized at $P_2$, the procedure may continue if a liquid barrier is further required. This type of barrier is normally used on thin long, neck vials and pipettes, and consists of a high viscosity liquid such as oil, jelly, cream etc. and the above procedure is repeated, utilizing the same principle, drawing a small amount of material into the open end of the container to act as the seal.

The next step may be accomplished in the chamber or removed therefrom. This step consists of rinsing away the unwanted liquid 36. A solvent or cleaning fluid may be introduced through the reservoir 38 and controlled by the valves 42, or in case the tray 24 is removed at this point in the procedure, the rinsing may be accomplished in the normal manner for the type of substance used.

Figure 8:
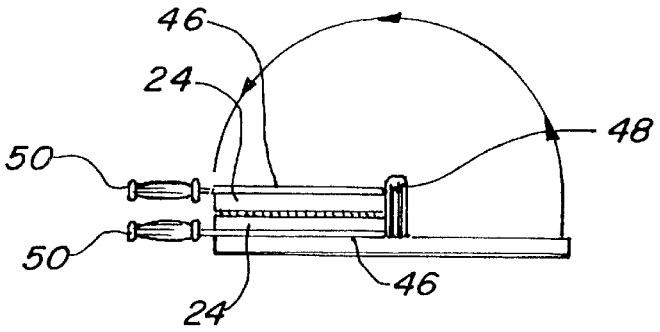
FIG. 8 is a diagram of one method of reversing the position of the containers by placing a second tray over the top of the first tray.
Figure 9:
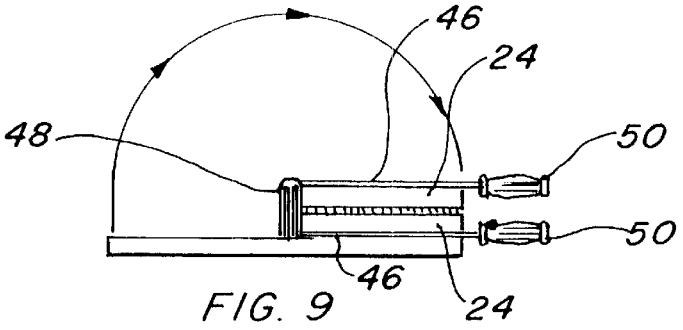
FIG. 9 is a diagram of the two trays after being turned over in concert.

The preferred next step, at this stage, is to remove the tray 24 from the vacuum chamber 28 and turn the tray upside down to position the openings in the container on the top, thereby making them accessible for inspecting the contents for proper level and uninterrupted fill. This reversal of the tray 24 may be accomplished by hand using a rigid flat object on the top and placing it on a table or workbench when reversed. Another method of reversal is depicted in FIGS. 7–9, and consists of a pair of flat rigid turning plates 46 connected together with a raised hinge 48 at the proper height of the tray 24 and the containers 20. The tray 24 with the upside down containers is placed on one of the plates 46 depicted in FIG. 7, and a second empty tray 24 is then placed on top of the containers as shown in FIG. 8. The pair are turned over 180 degrees using handles 50 that are located on each end of the plates 46 as illustrated in FIG. 9.

The final step in the process is to remove the original tray by lifting it from the second tray for turning right side up, or in the case the reversal was accomplished by hand from the rigid flat object and then sealing the container open top. It should also be noted that individual containers may optionally be removed one at a time and turned over during the sealing process. In any case, closing off with a seal is germane to the process, and it should be noted that any type of seal 51 may be used, such as a threaded cap 52, a resilient barrier 54, an eye dropper tip cap, a Uro-jet tip cap 58, a needleless tip cap 60, a male Luer-Lock connection cover 62, a female Luer-Lock connection plug 64, cotton tips, foam tips, a brush tip cover 66 and cork barrier 68. FIGS. 16–25 illustrate these seals 51 individually. The type of sealing may also include the aforementioned liquid seal that is accomplished in a previous step.

Figure 11:
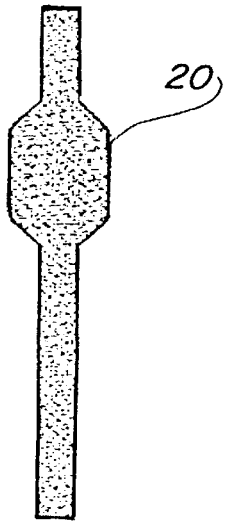
FIG. 11 is a representation diagram of an empty container at atmospheric conditions.
Figure 12:
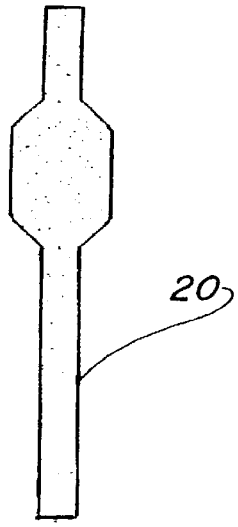
FIG. 12 is a representation diagram of an empty container evacuated in the vacuum chamber.
Figure 13:
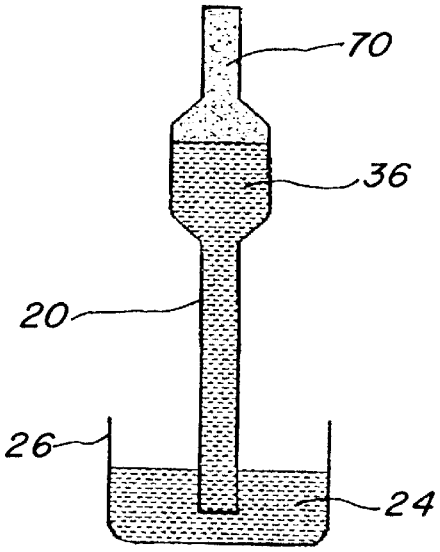
FIG. 13 is a representation diagram of a partially filled container as it draws liquid from the tray.
Figure 14:
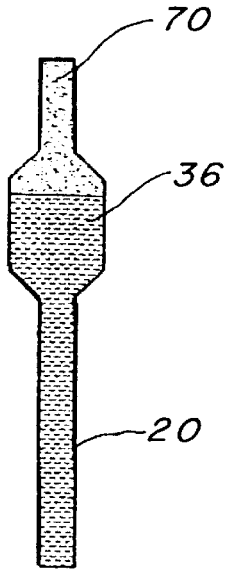
FIG. 14 is a representation diagram of a partially filled container.
Figure 15:
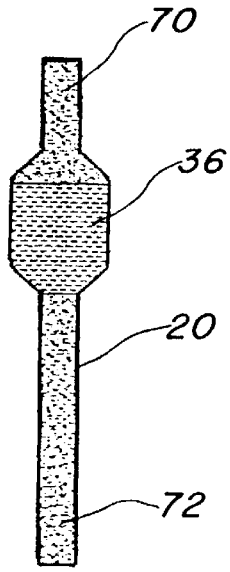
FIG. 15 is a representation diagram of a filled container having head and foot space within the interior of the container.
Figure 16:
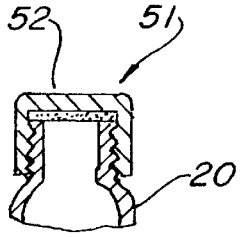
FIG. 16 is a partial cross sectional view of a typical threaded cap attached to a container.
Figure 19:
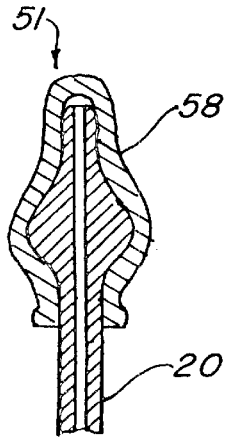
FIG. 19 is a partial cross sectional view of a typical Uro-jet tip with a resilient cap on a container.
Figure 17:
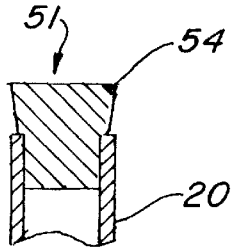
FIG. 17 is a partial cross sectional view of a typical resilient barrier attached to the inside neck of a container.
Figure 18:
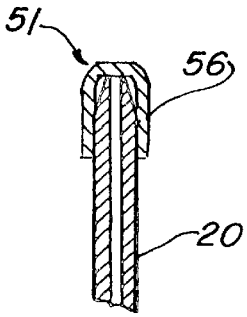
FIG. 18 is a partial cross sectional view of a typical eye dropper tip with a resilient cap on a container.
Figure 20:
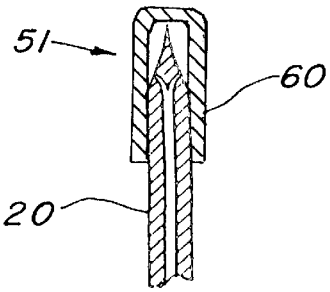
FIG. 20 is a partial cross sectional view of a typical needleless tip with a with a resilient cap on a container.
Figure 21:
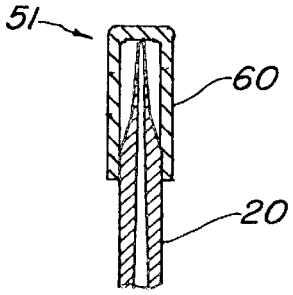
FIG. 21 is a partial cross sectional view of a typical needleless tip with a resilient cap on a container.
Figure 22:
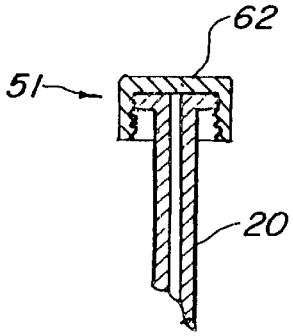
FIG. 22 is a partial cross sectional view of a typical male Luer-Lock connection with a cap on a container.
Figure 23:
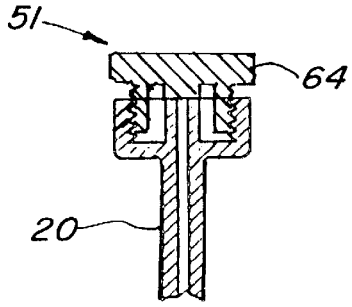
FIG. 23 is a partial cross sectional view of a typical female Luer-Lock connection with a plug on a container.
Figure 24:
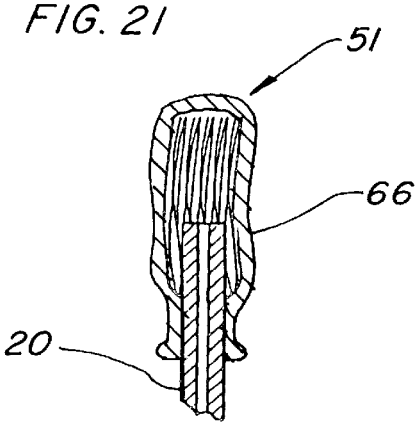
FIG. 24 is a partial cross sectional view of a typical brush tip with a cover on a container.
Figure 25:
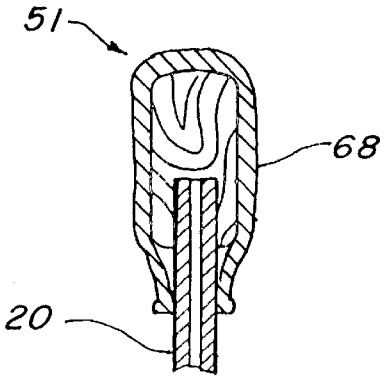
FIG. 25 is a partial cross sectional view of a typical cork barrier on the outside of the neck of a container.

FIGS. 11–15 illustrate the steps relative to filling the containers. The containers depicted pictorially are the pipette type and no seal is shown. FIG. 11 illustrates a pipette at normal atmospheric pressure with FIG. 12 illustrating a pipette with negative pressure inside when pulled in a vacuum. FIG. 13 shows the liquid product 36 being drawn into the pipette from the tray 24 equalizing the negative pressure inside. FIG. 14 depicts the liquid product 36 within the pipette after the product is depleted in the tray 24 or the pipette is removed leaving extra head space 70. FIG. 15 illustrates the product within the container with the desired head space 70 and, foot space 72 in the neck of the container.

Figure 26:
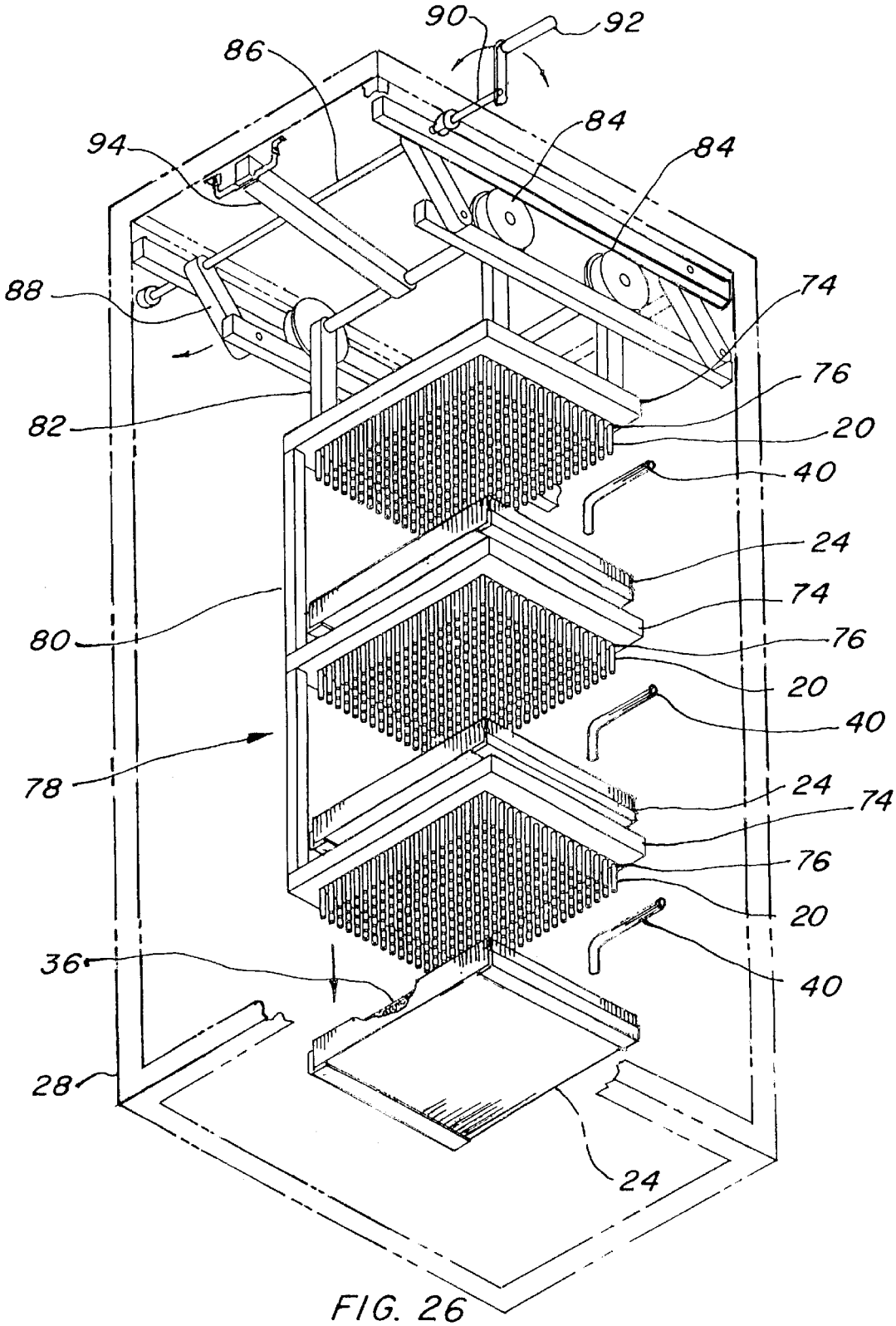
FIG. 26 is a partial isometric view of the second embodiment with the vacuum chamber shown in phantom to illustrate the components inside with arrows indicating the direction of movement.

The second embodiment is illustrated in FIG. 26 and differs only in that another step in the process has been added and a rack is used to hold the containers. This rack 74 is shown in a quantity of three, however any number may be used. The rack 74 may be fabricated of the same materials as the tray 24 and may include a raised flange all around as shown or may be a flat sheet of material. In either case the rack 74 contains a plurality of holes 76 in which the containers may be inserted with the necks down. The preferred racks 74 are attached together with a rack frame 78 that consists of a single side connecting member 80 and four posts 82 that include wheels 84 and axles 86, A pair of parallelogram platforms 88 are attached to the inside top surface of the vacuum chamber 28 and include an operating rod 90 that penetrates the vacuum chamber with a handle 92 on the outside of the chamber and a tongue 94 radially attached to the inside surface of the chamber.

The operation of the apparatus attached to the racks 74 permits the racks to be repositioned in a vertical plane without changing their lateral orientation. The handle 92 on the operating rod 90 is rotated manually or by a powered means to position the attaching legs of the parallelogram platform 88 which in turn elevates or lowers the bottom portion of the platform in perfect alignment with the top of the vacuum chamber 28. Since the tongue 94 is attached to the chambers inside surface, the lateral spacing of the racks 74 are always maintained due to the fact that the rack frame wheels 84 roll on the platform 88 when it moves axially from the rotation of the operating rod 90. While the preferred embodiment of the rack frame and parallelogram platform has been described it is not to be construed as the only method of raising and lowering the racks 74 since there are many and varied methods that may be used with equal ease such as a rack and pinion gear on the outside of the chamber sliding a shaft up and down, a lever arm on a similar shaft and so forth.

The next step in the process simply positions the rack 74, or multiples thereof, including the upside down containers 20, in the vacuum chamber 28 directly above the tray 24 in close proximity to the liquid product 36. In the final step, the chamber 28 is evacuated to the predetermined pressure $P_1$. The rack 74 is lowered until the container 20 openings are immersed in the liquid product 36 then the step of releasing the vacuum within the chamber 28 gradually at a predetermined rate sufficient to draw the liquid into the containers is accomplished as in the preferred embodiment. Additionally the liquid product 36 is simultaneously introduced into the tray at a rate sufficient to maintain a constant level above the container openings permitting a predetermined amount of liquid product 36 to enter the containers 20. The rack, or racks, 74 are then lifted up and the unwanted liquid product is rinsed away as before. The balance of the process is the same as previously described.

While the invention has been described in complete detail and pictorially shown in the accompanying drawings, it is not to be limited to such details, since many changes and modifications may be made to the invention without departing from the spirit and scope thereof hence, it is described to cover any and all modifications and forms which may come within the language and scope of the appended claims

What is claimed is:

1. A process of bulk filling which comprises the following steps:

a) arranging a plurality of containers, each having a single opening in their top, upside down in a raised peripheral lip tray, b) positioning the tray, including the upside down containers, in a vacuum chamber, c) evacuating the vacuum chamber to a predetermined level below atmospheric pressure, d) introducing liquid product into the tray, e) releasing the vacuum within the chamber gradually at a predetermined rate sufficient to draw the liquid into the containers, f) rinsing away the unwanted liquid product, g) removing the tray from the vacuum chamber and turning the tray upside down, and h) sealing the container open tops.

2. The process of bulk filling as recited in claim 1 wherein said step of arranging a plurality of containers, each having a single opening in their top, upside down in a raised peripheral lip tray, further comprises, tightly preparing the containers such that they are contiguous with each other requiring no further need for support within the tray.

3. The process of bulk filling as recited in claim 1 wherein said step of positioning the tray in a vacuum chamber further comprises, placing one or more trays on top of each other to permit multiple processing of filling the containers.

4. The process of bulk filling as recited in claim 1 wherein said step of evacuating the vacuum chamber to a level below atmospheric pressure further comprises, a vacuum negative pressure only sufficient enough to leave head space within the filled containers which head space defining a void above the product within the container permitting expansion and contraction of the liquid product due to various prevailing atmospheric temperatures and pressure differentials.

5. The process of bulk filling as recited in claim 1 wherein said step of sealing the containers open top further comprises, said sealing, selected from the group consisting of threaded caps, resilient barriers, eye dropper tip caps, Uro-jet tip caps, needle-less tip caps, male Luer-Lock connection covers, female Luer-Lock connection plugs, brush tip covers and cork barriers.

6. A process of bulk filling which comprises the following steps:

a) arranging a plurality of containers, each having a single opening in their top, upside down in a rack, b) positioning a raised peripheral lip tray, having liquid product therein, within a vacuum chamber, c) positioning the rack, having the upside down containers therein, in said vacuum chamber directly above the tray in close proximity to the liquid, d) evacuating the vacuum chamber to a level below atmospheric pressure, e) lowering the rack until the container openings are immersed in the liquid product, f) releasing the vacuum within the chamber gradually at a predetermined rate sufficient to draw the liquid into the containers, g) simultaneously introducing liquid product into the tray at a rate sufficient to maintain a constant level above the container openings permitting a predetermined amount of liquid product to enter the containers, h) rinsing away the unwanted liquid product, i) removing the rack from the vacuum chamber and turning the rack right side up, and j) sealing the container open top.

7. The process of bulk filling as recited in claim 6 wherein said step of arranging a plurality of containers, each having a single opening in their top, upside down in a rack, further comprises, positioning the containers such that they are immediately adjacent to each other without touching.

8. The process of bulk filling as recited in claim 6 wherein said step of positioning a raised peripheral lip tray, having liquid product therein, within a vacuum chamber, further comprises, placing a plurality of trays above each other to permit multiple processing of filling the containers using a like plurality of racks.

9. The process of bulk filling as recited in claim 6 wherein said step of evacuating the vacuum chamber to a level below atmospheric pressure further comprises, a vacuum negative pressure only sufficient enough to leave head space within the filled containers which head space defining a void above the product within the container permitting expansion and contraction of the liquid product due to various prevailing atmospheric temperatures and pressure differentials.

10. The process of bulk filling as recited in claim 6 wherein said step of sealing the containers open top further comprises, said sealing, selected from the group consisting of threaded caps, resilient barriers, eye dropper tip caps, Uro-jet tip caps, needle-less tip caps, male Luer-Lock connection covers, female Luer-Lock connection plugs, brush tip covers and cork barriers.

* * * * *